US006015076A

United States Patent [19]

Pennington

[11] Patent Number: 6,015,076

[45] Date of Patent: Jan. 18, 2000

[54] BRIDGING HIPBELT FOR A BACKPACK

[76] Inventor: Daryl Pennington, 123 Blair #C, Rock Springs, Wyo. 82901

[21] Appl. No.: 08/879,618

[22] Filed: Jun. 20, 1997

[51] Int. Cl.[7] ..... A45F 3/04

[52] U.S. Cl. ..... 224/637; 224/644; 224/262

[58] Field of Search ..... 224/627, 628, 224/633–637, 640, 641, 642, 259, 261, 262, 263

[56] References Cited

U.S. PATENT DOCUMENTS

| | | | |
|---|---|---|---|
| 3,516,586 | 6/1970 | Farnbach | 224/262 |
| 3,648,907 | 3/1972 | Romney | 224/635 |
| 3,653,566 | 4/1972 | Owens | 224/262 |
| 3,733,017 | 5/1973 | Pletz | 224/634 |
| 3,827,612 | 8/1974 | Mead et al. | 224/262 |
| 3,831,827 | 8/1974 | Olson | 224/262 |
| 4,015,759 | 4/1977 | Dreissigacker et al. . | |
| 4,049,164 | 9/1977 | Sullivan et al. | 224/633 |
| 4,099,657 | 7/1978 | Zufich | 224/262 |
| 4,114,788 | 9/1978 | Zulfich | 224/637 |
| 4,154,381 | 5/1979 | Zufich | 224/262 |
| 4,318,502 | 3/1982 | Lowe et al. | 224/642 |
| 4,561,578 | 12/1985 | Bell | 224/637 |
| 5,564,612 | 10/1996 | Gregory | 224/637 |
| 5,836,489 | 11/1998 | Swetish | 224/262 |

*Primary Examiner*—Gregory M. Vidovich

[57] ABSTRACT

A hipbelt for backpacks that is more comfortable and reduces fatigue by bridging across muscles and nerves in the gluteal region. The embodiment shown features a rigid crosspiece that prevents an attached taut belt or foam pad cushion from contacting the user in the lateral areas of the gluteal region. It only allows the cushion to contact the user in the central area of the gluteal region. A backpack frame connects to the crosspiece at the distal ends of the crosspiece. The connection at the backpack frame/hipbelt interface is a pivoting one.

13 Claims, 7 Drawing Sheets

BRIDGING HIPBELT FOR A BACKPACK

BACKGROUND

1. Field of Invention

This invention relates to backpacks, specifically to the hipbelt.

2. Description of Prior Art

Heretofore, backpack hipbelts have been set forth in U.S. Pat. No. 4.015,759 to Dreissigacker et al. (1977), U.S. Pat. No. 4,449,654 to Cappis (1982), U.S. Pat. No. 5,184,764 to Orovan et al. (1989), U.S. Pat. No. 5,547,461 to Levis (1994) and U.S. Pat. No. 5,429,287.

Dreissigacker et al. labeled the X,Y and Z axes as the axis perpendicular to the line of travel, vertical and the line of travel respectively. Herein the X axis is parallel to a line of horizontal travel the Y axis is perpendicular to the other axes and the Z axis is vertical. I have labeled the axes according to the scientific and engineering convention of labeling the vertical axis Z and the other reference direction with the primary axis, X. For purposes of discussion, hipbelts will be described as consisting of two parts. All hipbelts I have seen have at least two points connecting them to the backpack. The two points farthest apart in the Y axis will be referred to as the hipbelt pivots. They are not always designed to be pivots, but the fact that the belt is flexible and free outside these points means there is some pivoting. The hipbelt pivots will be used to divide the hipbelt into two portions. The portion rearward and/or between the two points will be referred to as the rear panel. The portion extending laterally and/or bending around forward of the pivots will be referred to as the front panel. In many instances the rear panel and the front panel will be continuous through the pivot points. This is most often true for side attachment hipbelts. These hipbelts usually are a continuous fabric covered foam pad that extends around the entire circumference of the user. The pivot points are usually a grommet attached in some way to that hipbelt at the side of the user.

Over the past 30 years hipbelts have developed into an essential part of a backpack. Their capability to transfer weight to the hips greatly increases the endurance of the hiker. To make the hipbelt more comfortable the manufacturers have made them wide and soft and yet they can still cause discomfort. I believe that to reduce this discomfort they design their packs to place some of the weight on the shoulders. This is reflected in their elaborately designed shoulder straps. There seems to be a need for a hipbelt that can comfortably transfer more weight to the hips.

The prior art shows that the idea of a semi-rigid rear panel is not new. In fact, I believe that 20 years ago, the taut belt type rear panel dominated the market. However, the art has tended away from the taut belt or any type of semi-rigid rear panel. The art has steadily tended towards soft, flexible hipbelts that conform to the waist. The idea seems to be to cushion all points of the waist from the stress of the load. This might work well except for the fact that in so doing the hipbelt is tightened over fat and muscle found lateral of the sacrum and lumbar vertabrae. Fat is not a structurally sound material. Muscle has some ability to resist deformation under stress but it also expands and contracts with each step. The hipbelt slides down while the muscle is contracted and then cinches on the muscle when it attempts to expand. This cinching reduces the muscles ability to expand and thereby its ability to do work. It may also squeeze nerves within and undemeath the muscle. This may seriously affect the muscles and cause fatigue.

The taut belt rear panel still found on some external frame packs can effectively bridge across the gluteous muscles.

The rear panel is attached to the frame for its full width so it cannot pivot relative to the backpack at its pivot points. The angle with which the panel meets the back is determined by the angle designed into the pack frame plus the angle imparted to it due to bending of the back. Therefore the panel will only intermittently parallel the back where it contacts it. When it is not parallel it will be applying pressure primarily along its upper or lower edges. This amounts to reducing the area of contact and thereby increasing pressure. I believe increasing pressure can only increase the likelyhood of damage to the tissues and discomfort to the user. Some packs have a rear panel that is loose rather than taut. The slack allows some rotation of the panel even though that requires torsional flexure of a band of fabric about 3 inches wide. Kelty, Inc. of St. Louis, Mo., produces the "Yukon", a backpack is of this type. The only gain in rotation it offers is at the expense of bridging ability. In my opinion, it is not possible to achieve a significant amount of rotation by allowing slack without loosing the bridging capability. I think this is because the back in the gluteal region is approximately flat in the central half and only slightly curved lateral of the central half. Obesity may preferentially increase the amount of fat over the lateral areas and might even require a rear panel that is concave towards the back to bridge across the lateral areas. That is a loose belt simply has too much of a concave curve to bridge adequately. Many modem packs have stabilizer straps. These are adjustable straps that connect to the side of the pack and to the hipbelt at a point a few inches forward of the pack. If tight, they may in affect bridge some af the gluteal region. In essence, the stabilzer straps have formed new and wider pivot points. The instruction page for the Yukon backpack says "The stabilizer straps on the side of the belt must not be over tightened. Leave them slightly loose".

Dreisigacker et al. show a taut belt design that cannot pivot relative to the backpack around the Y axis. Furthermore, if it did pivot around the Y axis at the same joint that allows pivoting around the other two axes it would be uncomfortable, in my experience. The weight of the load would tend to jackknife the frame around that joint. At the very least, this would cause the taut belt to dig in along its lower edge. To avoid this problem it is neccessary to locate the Y pivot at or forward of the users back/cushion interface. One example of the Y pivot being located in front of that interface is side attachment packs.

Side attachment pack frames attach to the hipbelt lateral of the center of the pelvic region. In this configuration both the front panel and the rear panel pivot with respect to the backpack. Such hipbelts usually are flexible enough that the rear panel pivots through flexure relative to the front panel also. This allows the rear panel to match the angle of the back at all times. Another advantage of the hipbelt pivots being located this far forward is that the rear panel can contact the back higher on the back; higher on the sacrum and ilium. This can feel more comfortable and avoids some nerves on the posterior of the sacrum which may be compressed by some hipbelts. However, all side attachment hipbelts to date have a flexible, comfortable rear panel. The fact that the weight is applied on the sides may mean that the force on the rear panel has a larger component in the forward direction. This may cinch around the gluteus and pyriformis muscles with more force. In turn, this may lead to discomfort. In my experience, hipbelts worn too low make the muscles feel tired too quickly. I think that some muscles or portions of muscles are made weaker either by cinching and/or nerve compression. Then, the remaining muscle mass quickly becomes tired due to compensating for the ineffective muscle. It is difficult to distinguish between ordinary muscle tiredness and the tiredness due to a hipbelt worn too low. I believe that is why side attachment hipbelts have never been improved or gained in popularity. A further difficulty of side attachment hipbelts is that they usually require a system to adjust the location of the Y-pivots. One complex example is found in the hip-brace in U.S. Pat. No. 5,429,287. This incurs more expense and weight and can be an awkward system.

Modern internal frame packs often have a sheet of semi-rigid plastic for a frame. They have a rear panel that is sewn to the pack sack. The configuration is such that in some cases either the plastic sheet bridges or it holds the belt somewhat taut and some bridging is achieved in that way. In the former case, the sheet in the gluteal region may flex a little around the Y axis but essentially takes an angle that parallels the back. This is seen from the premise that the sheet was rigid enough to bridge across the gluteal region. In the latter case, the configuration is similar to an older style taut belt pack and prone to drawbacks inherent in that design.

Objects and Advantages

Accordingly, several objects and advantages of my invention are described below. An object of this invention is to provide a rear panel that bridges across soft tissures. The lumbar, and gluteal regions are quite complex. A good hipbelt should avoid nerves exiting the sacrum as well as avoid putting much pressure on the gluteal muscles. Thus, it can conform only in the central region of the back and pressure should taper off lateral to this central region. The width of the central region varies with the anatomy but the width of the central region of an adult is about 8 inches. That is, the rear panel should bridge across tissues lateral of a central zone about 8 inches wide. This rear panel will apply force primarily to tissues that are fairly durable. This hipbelt will not cinch around muscles and compress nerves and thereby cause undue fatigue. Another adavantage is that it rotates relative to the backpack frame and thereby matches the angle of the back. The advantage is that the user is more comfortable. It is hoped that these phenomenon will allow side attachment hipbelts to function better and in so doing allow hikers the advantages of that hipbelt system. Previously, the advantage of having the rear panel higher on the sacrum, lumbar vertabrae and the os innominatum (crest of ilium) while bridging across soft tissues was not available to users. A hipbelt which can be fitted with a variety of cushions so as to fit any anatomy is another object. Further, an easy, inexpensive, lightweight Y-pivot adjustment system is allowed by this invention. In addition. the bridging across the gluteal region allowing air to circulate and cool the region.

DRAWING FIGURES

DESCRIPTION FIGS. 1 to 7

Figure 1:
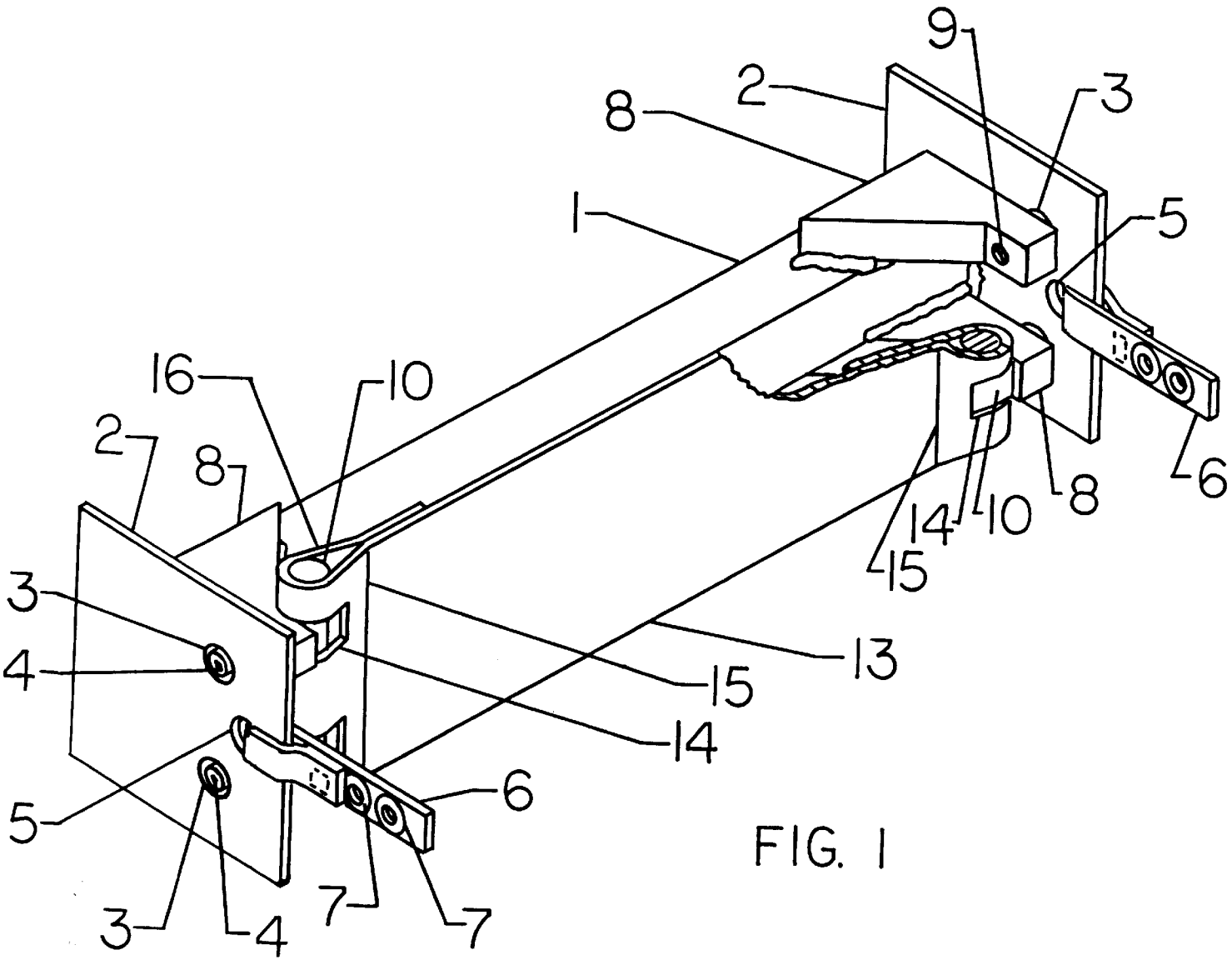
FIG. 1 is a perspective view of a bridging rear panel with a portion broken out.
Figure 5:
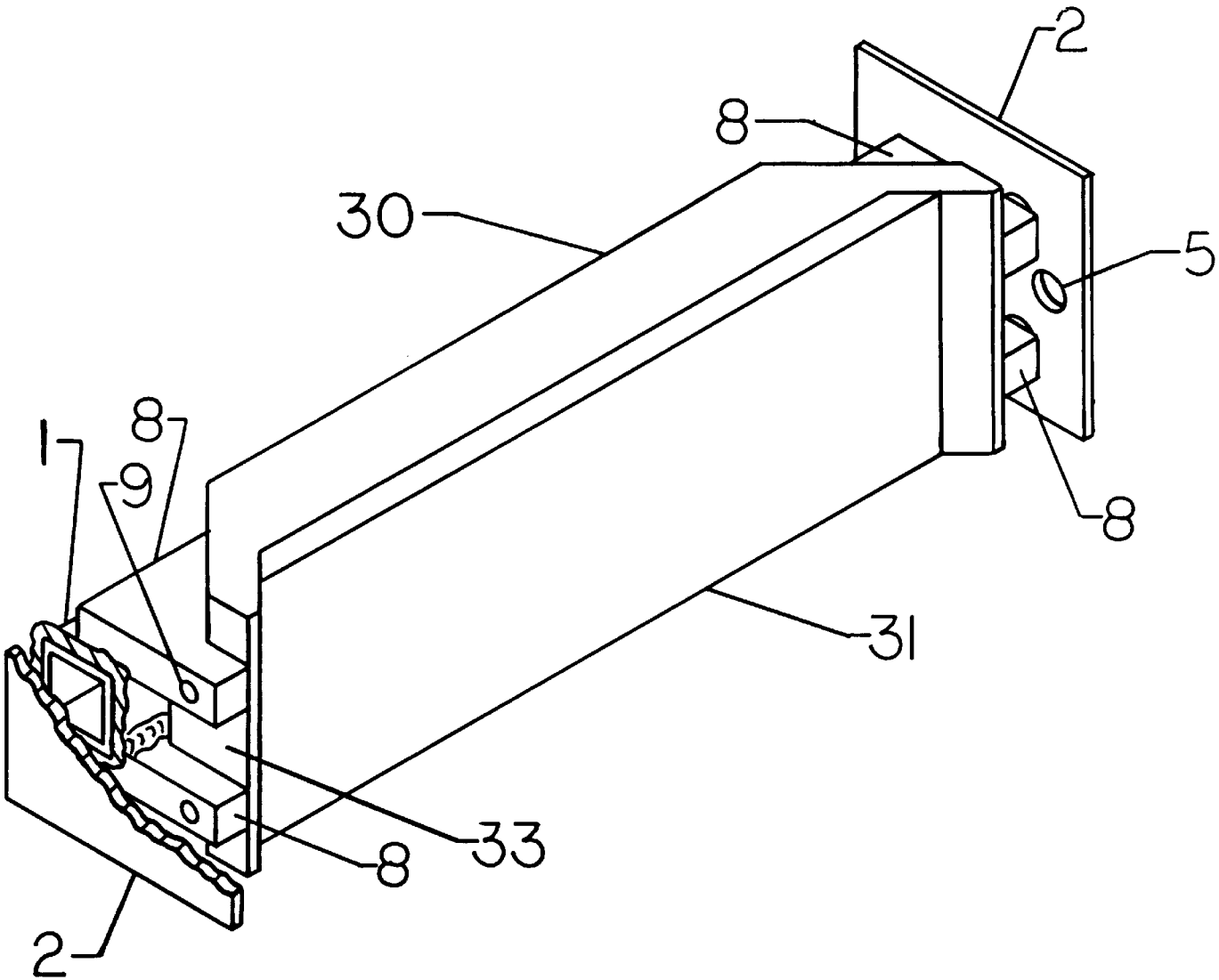
FIG. 5 is a perspective view of rear panel of FIG. 1 with a modified cushion.

The versatile embodiment of FIG. 1 has approximately one quarter of belt 13 broken out to display details of the rear panel. Crosspiece 1 is a metal, square sectioned tube; although it could be constructed in almost any shape and material. Pivot bracket 2 is a square plate. Pivot bracket 2 is of material similar to crosspiece 1 and is welded to it around the circumference of crosspiece 1. Access hole 3 in pivot bracket 2 allows access to socket head bolt 4. The top of the head of socket head bolt 4 is approximately flush with the surface of pivot bracket 2. Cushion bracket 8 has a bolt hole 9 passing through it parallel to the Y axis and coaxial with hole 3. The base of the head of socket head bolt 4 contacts and forces against the exterior side of cushion bracket 8, while the shaft of socket head bolt 4 passes through cushion bracket 8. The exterior side of bracket 8 is best shown in FIG. 5. It is the left side of the upper, left bracket 8. This, exterior side of bracket 8 and exterior end of hole 9 are best shown in FIG. 5 while FIG. 1 shows the interior side of bracket 8 and interior end of bolt hole 9. Bolt hole 9 allows the shaft of socket head bolt 4 to pass through bracket 8 and then thread into post 10. Cushion bracket 8 is approximately flat and triangular except for a square end through which hole 9 passes. The four cushion brackets 8 are of material similar to crosspiece 1. The cushion brackets 8 are a short distance from the pivot brackets 2 and are welded wherever space permits to crosspiece 1. There are two access holes 3 through each of the two pivot brackets 2. One Y/secondary pivot hole 5 through each of the pivot brackets 2 allows attachment of strap 6 by means of strap 6 passing through hole 5 and doubling back on itself and upon stitching forming a loop. Y/secondary pivot hole 5 can be a Y-pivot or the Y-pivot can be extended forward with strap 6 to Y-pivot grommet 7 as is done in this embodiment. Each of the two straps 6 has two grommets 7 which allow the rear panel to be adjustable in respect to the distance from the cushion to the Y-pivot.

Figure 2:
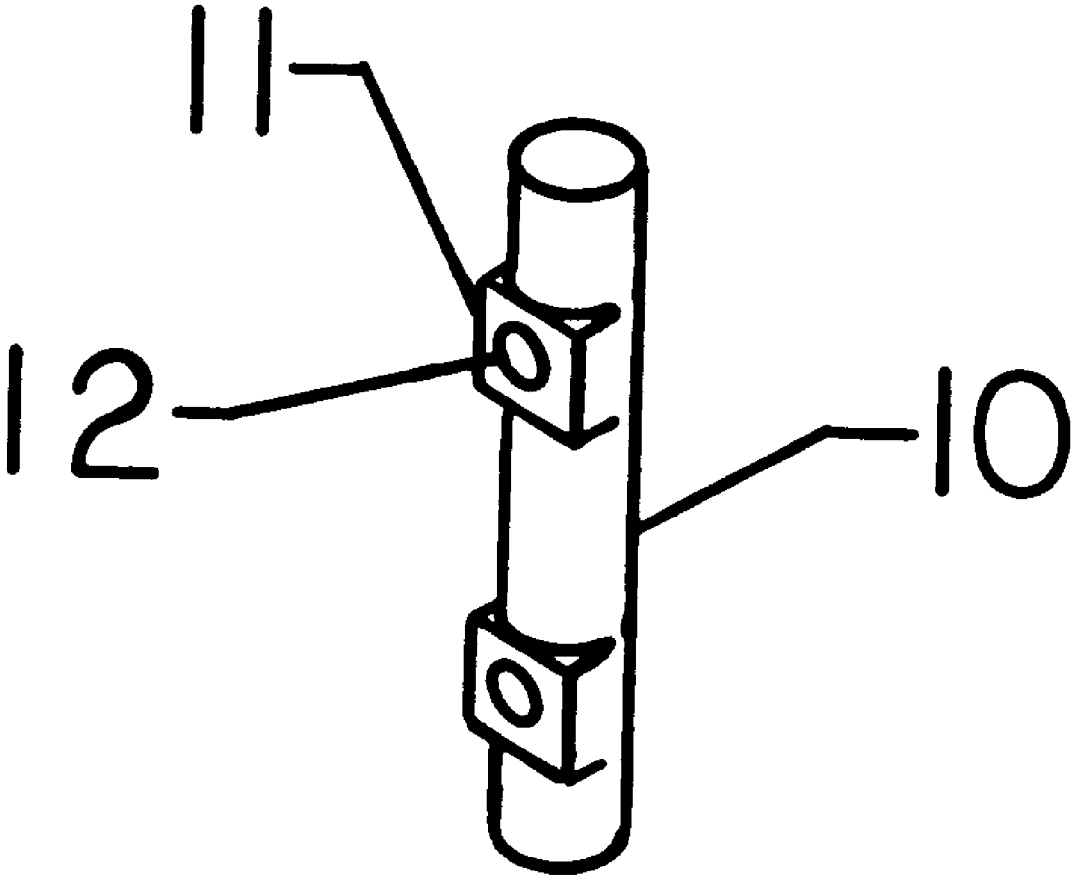
FIG. 2 is a perspective view of post 10.

FIG. 2 is a perspective view of metallic post 10. Post 10 is cylindrical except for two square ended protrusions 11 which are on the same side of post 10. The square end of protrusion 11 mates with an interior, side surface of cushion bracket 8. Threaded post hole 12 is centered on protrusion 11 and passes through post 10.

Referring again to FIG. 1, belt 13 is made of fabric. Belt 13 is comprised of two portions. The portion approximately between the two stitchings 15 will be referred to as the belt cushion and the two portions distal of the belt cushion will be referred to as the belt ends. In this embodiment each end is a loop 16. The two loops 16 have two openings 14 through which protrusions 11 pass. Stitching 15 attaches the end of the fabric to the rear side of the belt and in so doing, loop 16 is formed. After stitching, post 10 is placed inside loop 16.

Figure 3:
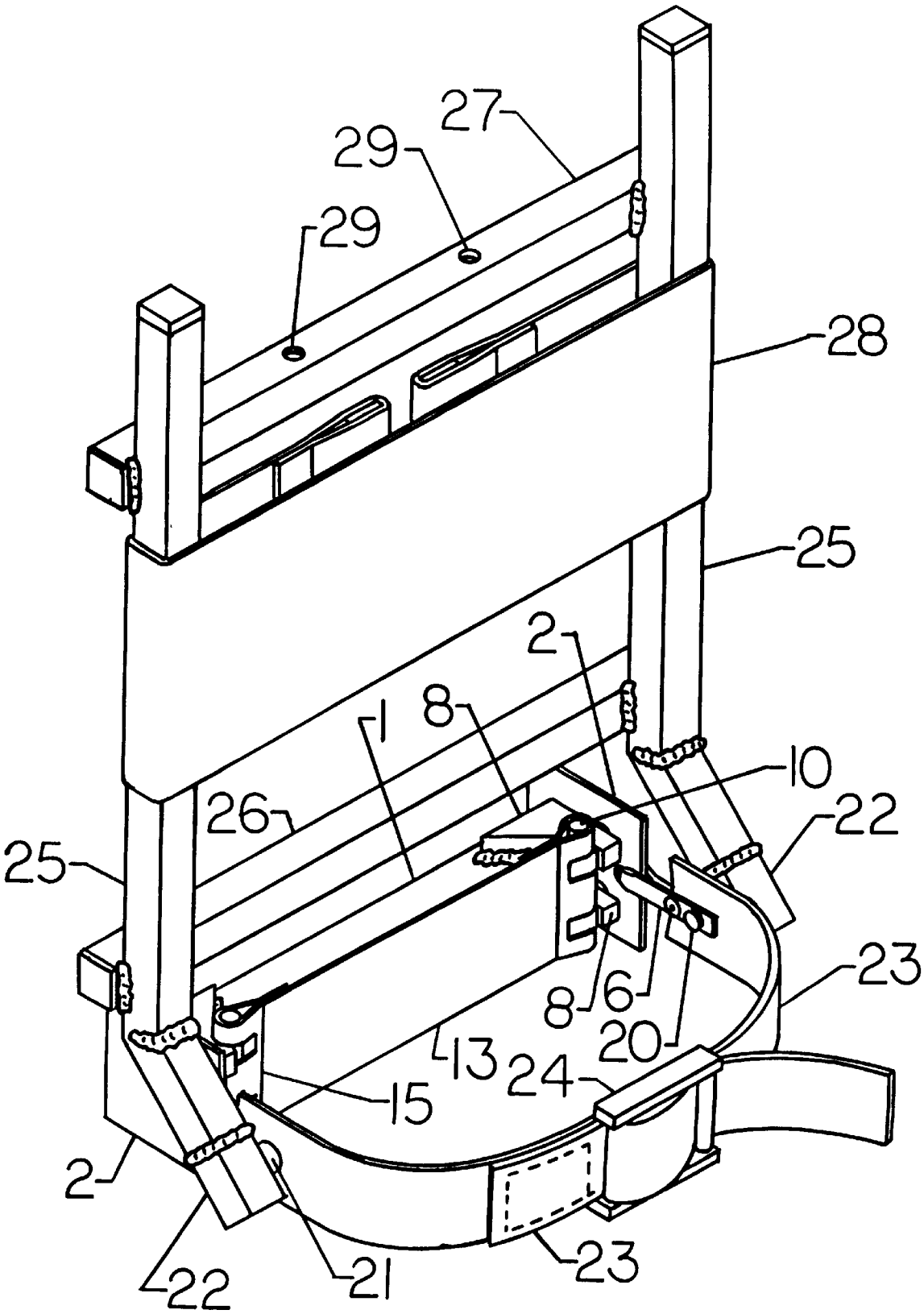
FIG. 3 is a perspective view of the rear panel of FIG. 1 in assembly with a front panel and a backpack.
Figure 4:
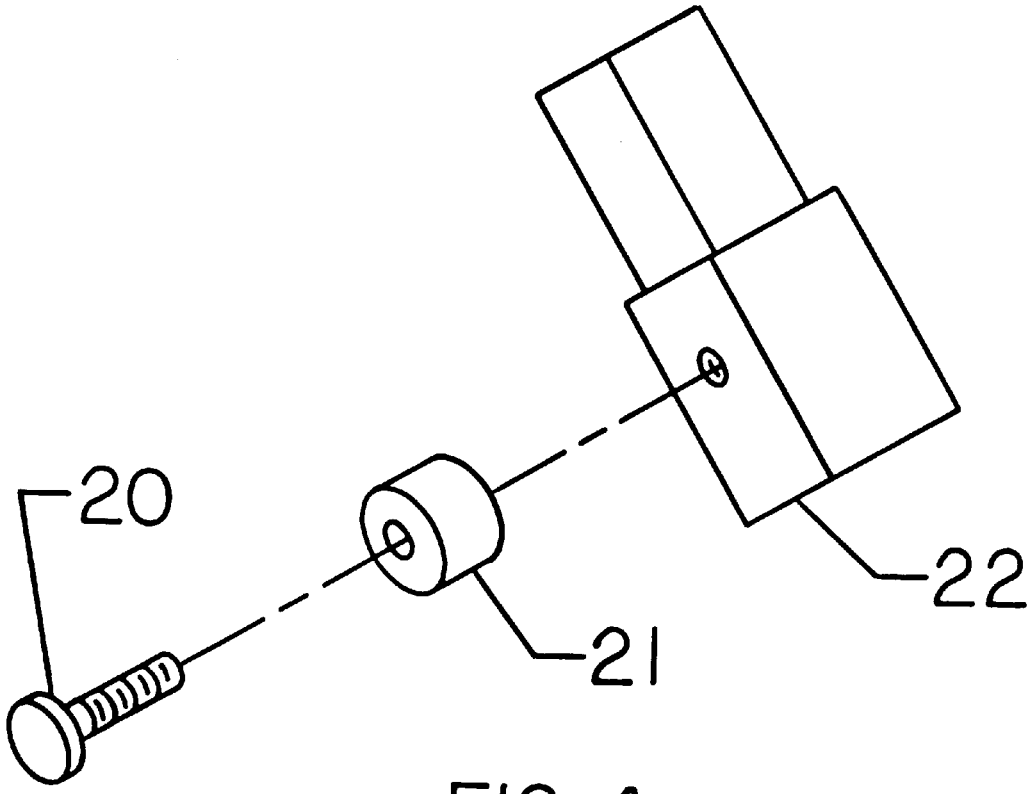
FIG. 4 is an exploded view of the parts of the pack frame end.

FIG. 3 is a perspective view of the rear panel of FIG. 1, a front panel 23 and a welded backpack frame in assembly. The two fabric halves of front panel 23 are connected together by buckle 24. Bolt 20 passes first through grommet 7 and then through a grommeted hole in the front panel, then through spacer 21 and then screws into threaded backpack frame end 22. FIG. 4 shows these parts in exploded view. Spacer 21 is a cylindrical sleeve. Frame end 22 is solid, inset and welded into the tubular frame. The backpack frame consists of two side tubes 25, a lower cross tube 26, an upper cross tube 27 and fabric backband 28. Side tubes 25 have an approximately 45 degree bend towards their lower end. Upper cross tube 27 has two holes 29 through it. Shoulder straps are not shown but could attach at the two holes 29 and spacers 21. Fabric backband 28 has metal strengtheners in loops at its ends and is is held taut by lacing between those ends.

FIG. 4 shows the pack frame end in exploded view. All three parts are metal. Spacer 21 could be threaded so as to function as a lock nut as well as a spacer.

FIG. 5 shows the same rear panel rigidifying structure as shown in FIG. 1 with a foam pad cushion mounted onto it in place of belt 13 and post 10. In FIG. 5, approximately one half of the left pivot bracket 2 is broken out to show details of the rear panel rigidifying structure and cushion. The foam pad cushion is comprised of a plastic structure 30 and a foam pad 31. Foam pad 31 is adhesively affixed to structure 30. Foam pad 31 is planklike and its' shape is adequately described by this perspective view. Pad 31 is a right trapezoidal prism having a section parallel to the X-Y plane identical to its' top throughout.

Figure 6:
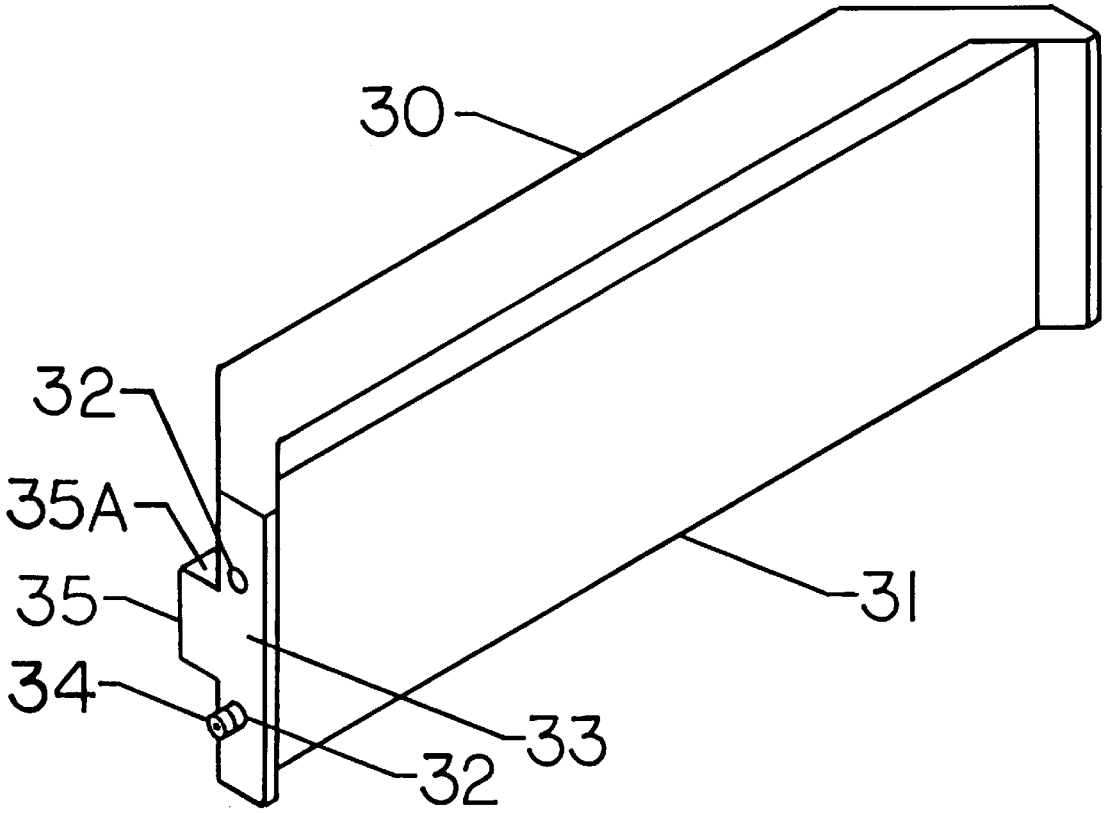
FIG. 6 is a perspective view of the modified cushion.
Figure 7:
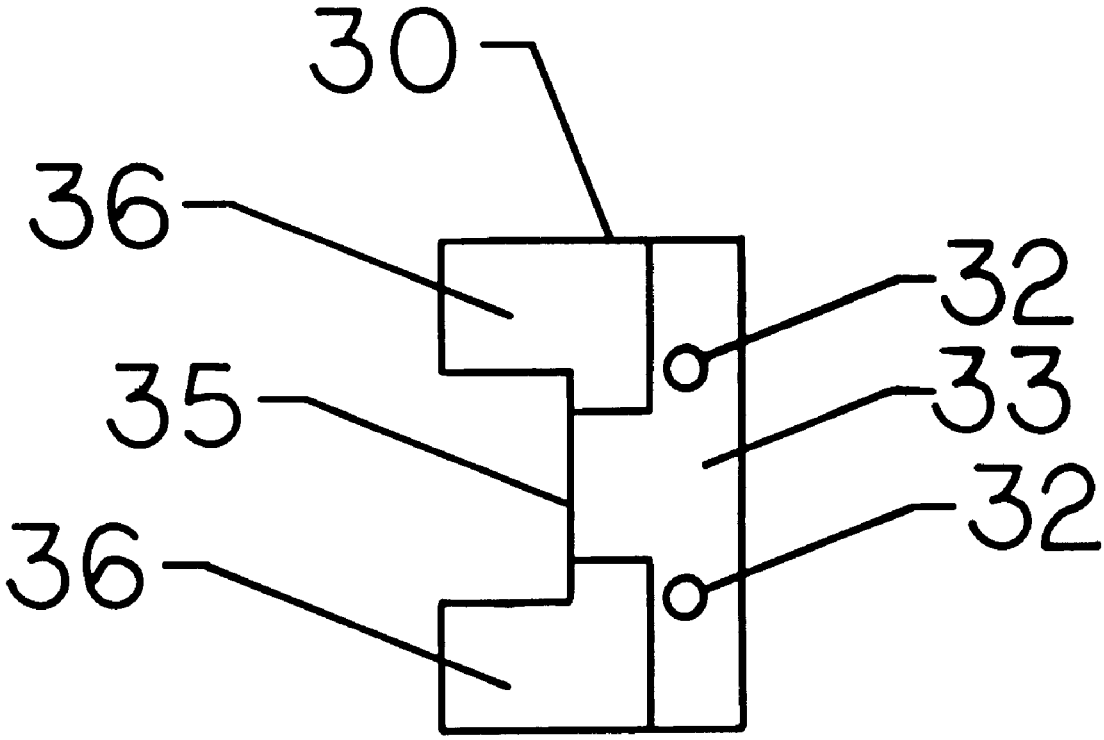
FIG. 7 is a side view of the modified cushion.

FIGS. 6 and 7 show the same foam pad cushion as in FIG. 5. Both sides of structure 30 are formed by surface 33 which is planar and T shaped. The portions of the surfaces 33 around the four threaded set screw holes 32 mate to each cushion bracket 8 in the same way as does the surface of protrusion 11 around hole 12 on post 10. The singular arm of the T shape forms the side surface of the four sided projection 35. There are two threaded set screw holes 32 piercing surface 33. They are coaxial with the bolt holes 9. One set screw 34 threads into each hole 32 in assembly, though, for clarity, only one is shown in FIG. 6. The set screws 34 are insufficiently long to appear in FIG. 5 but do occupy all of the bolt hole 9. The Tear surface of projection 35 is coplanar with the surface forming the front surface of a trough that spans the width of the rear of structure 30. The trough is visible in side view in FIG. 7 on the left side of the figure. The view is down the length of the trough. The top and bottom surfaces of projection 35 are identical triangular surfaces 35A parallel to the X-Y plane. Projection 35 is bordered above and below by vertical, planar surfaces 36 rotated about an axis parallel to the Z axis such that surface 36 is 45 degrees from both the X and Y axes. These also form the sides of ribs that span the length of the rear of structure 30 above and below the trough. The ribs form the top and bottom of the trough. In assembly, the trough does not contact crosspiece 1, but closely parallels three sides of crosspiece 1. The trough and two ribs form the rear of structure 30. The top and bottom of structure 30 are identical and parallel. The front of structure 30 is formed by a central planar surface parallel to the Y-Z plane and two lateral, planar, vertical surfaces rotated about an axis parallel to the Z axis such that the surface is 45 degrees from both the X and Y axes.

Operation FIGS. 1–7

Crosspiece 1 provides a rigidifying structure that does not allow the rear panel to conform to the user's back in the lateral areas of the gluteal region. It provides the strength to bridge across much of the gluteal muscle. Structure 30 also has the strength to bridge across that area. Bridging is essential to relieving the pressure on those muscles and nerves and allow normal muscle function.

To construct the metal rigidifying structure of FIG. 1, first weld the pivot brackets 2 to crosspiece 1. A thick weld can be used if it is machined away from where cushion bracket 8 mates with crosspiece 1. Bracket 8 may be welded on with thick welds except where space does not permit near pivot bracket 2. Assembly of the taut belt type cushion or foam cushion to the remainder of the rear panel is straightforward. Insert post 10 into the sewn loop 16 end of belt 13 such that the protrusions 11 protrude through the openings 14 in belt 13. Pass the bolts 4 through both access holes 3 and bolt holes 9, then screw them into post holes 12. Repeat this procedure on the other side taking care to keep the torque on each bolt 4 approximately the same while tightening. Belt 13 conforms to the user's back in the central portion and is taut enough that it does not contact lateral of the central portion or does so with reduced pressure.

The structure being strong enough to bridge is not generally soft enough to contact the user's back without damaging it over time. Therefore a cushion of some kind is needed. Specifics of anataomy vary with the individual so cushion preferences are expected to vary. The figures illustrate two types of cushion without any particular contouring shown on either. However, it should be understood that any specific cushion can be used with this invention.

The tension of belt 13 can be adjusted by changing the length of belt 13 itself or by changing the length of the attachment means. Commonly, the tension of a taut belt is changed by means of turnbuckles or drawstrings generally found between the ends of the belt which are looped around and to the rear of the frame. In this configuration that would place the turnbuckles between the ends of belt 13 instead of the ends being sewn to the rear of belt 13. To use these particular solutions a pad of foam might have to be inserted between the belt cushion and the belt adjusting means to cushion from the adjusting means because post 10 has a smaller diameter than most pack frame tubes. Tensioning means could be placed behind or onto a crosspiece and connected to a belt with cables or levers. Alternately, the adjustment means could be deleted and the belt ends can be sewn together to form a single large loop instead of having a sewn loop at each end. A belt loop and tension adjustments can also be accomplished using a hook and pile closure or double bar slides. For example, instead of the fabric ends being attached to the belt cushion by stitchings 15, the ends may be connected with adjustable hook and pile or double bar slides.

The tension of belt 13 could be adjusted by the use of shims or by designing the system such that post 10 does not contact bracket 8 but is attached solely by bolts 4. Tension would then be adjustable using bolts 4. An adjustable quick release bolt as are used on bicycles could replace bolt 4. The crosspiece could be designed with a hinge in the Z-axis and by opening around that hinge, it could tension the belt 13.

Due to foam pad 31 the foam cushion conforms to the central portion of the user's back. Plastic structure 30 is rigid enough to bridge across tissues lateral of the central portion of the back. That is, lateral of the central portion of the back the foam pad 31 either does not contact the back or does so with less pressure than it would if it conformed to the back.

The cushion reduces the stress of the load by its softness. Shaping the cushion to facilitate placement of that load on the most structural tissues also reduces the stress on the user. These advantages would be reduced if the cushion were changing its angle to the user's back with every step. Therefore it is essential that the rear panel pivot relative to the backpack. A pivot such as bolt 20 and grommet 7 allows the rear panel to move with the tissues it contacts and keep a constant angle to them regardless of how the backpack moves. This pivot can be called the backpack or y pivot. A secondary pivot, such as Y/secondary pivot 5 used in conduction with the bolt 20 and grommet 7 pivot, allows the rear panel to self adjust its angle to the tissues it contacts. This has advantages such as convenience and additional independence from backpack movements. A secondary pivot is necessarily between a backpack pivot and a rigidifying structure and therefore incorporated as one link in the connection between the backpack pivot and the rigidifying structure. In the presently preferred embodiment the secondary pivot is pivot 5, a hole in bracket 2, and strap 6 which freely pivots in pivot 5. Owing to the flexibility of strap 6 both the backpack and secondary pivots can pivot well parallel to both the Y and Z axes and slightly parallel to the X axis. This may help to make the unit more comfortable. The most critical axis about which both pivots must rotate is parallel to the Y axis. However, some user's may prefer the greater control of the angle at which the rear panel contacts the back. In this case, one, not two pivots between the rear panel and the backpack would be preferred. This assumes a means of setting the angle the cushion makes to the Y pivot which is easy to do.

Bolt 20 and grommet 7 form a pivot parallel to the y axis that would, if unobstructed, allow 360 degrees of rotation. In this embodiment bolt 20 forms a shaft attached to the frame while the rear and front panels have holes that freely rotate around the shaft. However, in use at most about 45 degrees of rotation is required. 45 degrees of rotation could be accomplished by a number of other types of pivots. Owing to the flexibilty of thin straps such as strap 6, 45 degrees of rotation could probably be accomplished even if grommet 7 were bolted rigidly to frame end 22. Similarly, a thin cable fixed to frame end 22 would be an adequate pivot. Such a thin, flexible connector would flex at the junction to the backpack as well as at the junction to the rear panel and so it would form a backpack pivot and a secondary pivot.

It is important that the rear panel accomadate a variety of anatomies and amount of outerwear. One way to accomplish this is to make the distance between the rear panel and the backpack frame adjustable. Strap 6 adjustably connects pivot bracket 2 to the Y-pivot of the pack, bolt 20. Adjustment is made by removing bolt 20 and reassembling it using the other grommet 7. Bolt 20 and spacer 21 have smooth, round surfaces so would have to be screwed in with a pliers. Adjustment could also be made using buckles, hook and pile, and by substituting a turnbuckle and/or a cable for strap 6 etc. Experiment showed that the Y pivot should be forward of the cushion/user's back interface. The Y/secondary pivot 5 is forward of the front of the cushion when not in use. The Y/secondary pivot 5 is even farther forward of the front of the cushion/user's back interface because the cushions compress or stretch in use. The distance parallel to the X axis between the front of the cushion and the Y-pivot when not in use is less than when in use because the cushions compress or stretch. This location is also easier to determine than is the cushion/user's interface. While the Y-pivot between a rear panel and a backpack is best located at or forward of the cushion/user's back interface, the secondary pivot need not be in front of the cushion/user's back interface.

Y/secondary pivot 5 forms a secondary pivot about which the bridging hipbelt can rotate to parallel the user's back at the area of contact. Y/secondary pivot 5 is centered on the cushion so the loads placed above and below the pivot 5 axis are approximately equal. This depends on specifics of the user and the backpack. Holes parallel to, but offset in the Z dimenson from pivot 5 would make the pressure on the cushion nonuniform from top to bottom which could be beneficial. Y/secondary pivot 5 could have bolt 20 pass through it and into frame end 22. In this case Y/secondary pivot 5 functions as a primary Y pivot not as a secondary Y pivot. Pivot bracket 2 could have many holes parallel to the Y axis passing through it which would provide adjustability of the pressure balance on the cushion. A cushion could connect through a Y pivot to a bracket whereby the cushion would rotate relative to the pack frame and to the rigidifying structure.

A further use of such holes would be for the attachment of another strap similar to strap 6. Two straps would be attached to bracket 2 and the other ends of both those two straps would attach to the pack's Y pivot. This would provide a means of setting the angle of the cushion to the Y pivot should this be desirable. Interconnecting a strap to its counterpart strap on the other side of the hipbelt is an option that allows the straps to self-equalize on each side. This could be useful if it was desirable to have a single buckle at the rear of the panel adjust both straps. One means of interconnecting both straps is to pass two straps through the pivots 5 from the inside and then pass them around the rear of the hipbelt and join them with buckle or turnbuckle, etc.

Summary, Ramifications and Scope

Thus, this invention should be seen to provide a more comfortable and efficient hipbelt. Some of the factors contributing to the comfort of this hipbelt are as follows:

- it bridges across nonstructural tissues to apply pressure primarily to more structural tissues,
- it pivots relative to the backpack to consistently apply the load to the user's back,
- it can be fitted with a variety of cushion types and shapes to fit a variety of anatomies,
- it allows a lightweight, inexpensive system for adjusting the distance from the hipbelt to the Y pivot,
- it has better ventilation for cooling.

Although the description above contains many specificities, these should not be construed as limiting the scope of the invention but as merely providing illustrations of some of the presently preferred embodiments of this invention. For example, the cushion could be a series of relatively large air pockets as exists in AIR-brand gas pocketed shoes; AIR is a trademark of Nike, Inc. Of Beaverton, Oreg. Air pockets of any size could be adjustable in terms of air pressure. Belt 13 could have padding attached to the front of it. This padding could be contoured to put pressure on the ilium or relieve pressure on the vertabrae and sacrum. A plastic and foam cushion can be shaped such that it bridges in more complex patterns than are possible with a taut belt cushion. For example, it could put more or less pressure on the sacrum than a taut belt. Foam pad 31 could have a groove cut for the spine or a relieved area for the sacrum. Foam pad 31 could be made of other cushioning material such as soft, springy or breathable fabric or pile. Any configuration of generally higher pressure toward the center and lower pressure lateral of the center would be a bridging rear panel. If a belt conforms to the gluteal region it would give a somewhat constant pressure across the entire region. The qualification for bridging is that it not be entirely conformable to the gluteal region and that it pivot parallel to the Y-axis relative to the backpack frame. Foam pad 31 could be covered with fabric or attached to the structural portion of the hipbelt by stitching of the fabric cover or by bolts, clamps, etc. Instead of a single foam pad 31 multiple pads could be used. For example, the foam padding could consist of two pads that in combination cover approximately the same region as foam pad 31 but are seperated by an X-Z plane at the midpoint of the region covered. Further, these two foam pads could be adjustable by replacement or by pivoting parallel to a Z axis.

The rear panel could have fabric compartments or other means of attaching items such as clothing and water bottles to it. The backpack Y pivot could be a narrow, thin a strip of fabric, leather, rope, or cable fixed to the frame and pivoting by flexure of the fixed material. The pack Y pivot could be a loosely fitted pocket or slot into which the frame fits and yet can pivot. Natural Balance, Inc. manufactures packs that pivot through such a connection. Pivot bracket 2 and cushion bracket 8 could be interconnected by moving them closer together and welding them together or be interconnected by forging, casting or plastic molding them as a single unit. Similarly, bracket 2 and bracket 8 and crosspiece 1 could be formed as a single unit. Crosspiece 1 could be replaced by two lighter tubes or one or more ribs if molded plastic. Crosspiece 1 could be adjustable in length to accomadate various anatomies. For example, it could telescope or some or all of the brackets could mount adjustably on Crosspiece 1. The presently preferred embodiment is the foam cushion. Crosspiece 1 and plastic structure 30 are both rigidifying structures that share characteristics to such an extent that they could supplement or replace each other. Should a consumer have a preference for one type cushion the entire metal rigidifying structure and plastic structure 30 could be replaced with a single structure that rigidifies the cushion and has pivot attachment means. That structure could be of metal, plastic or fiber reinforced plastics. For example, plastic structure 30 could also have pivot brackets molded at its' sides and then the metal structure would not be required. Alternately, strong, elastic material as is used in archery bows could be formed into a thin planklike shape, the front covered with foam and straps attached to holes molded into the side ends. In use it would bend to form a curve similar to that of a taut belt. This type design has weight and space advantages. A planklike, rigidifying structure could also be used to tauten a belt for a cushion with the addition of molded brackets for the belt. Alternately, plastic structure 30 could have secondary pivots molded to its' sides.

In this embodiment the rear panel the front panel and the backpack are connected by a pivot. The rear panel and front panel could be joined together at that location. One embodiment facet common to side attachment packs is that of the rear and front panel being one continuous unit with a pivot mounted in or on it. This still has flexible pivoting between the rear and the front panels. Thus the scope of the invention should be determined by the appended claims and their legal equivalents, rather than by the examples given.

I claim:

1. A rear panel of a hipbelt for a backpack, the backpack having two spaced y pivots attached thereto configured to be located adjacent respective sides of an individual when the backpack is worn by the individual, wherein the two y pivots lie in a plane substantially parallel to a y axis and are substantially coaxial, wherein the y axis is in a horizontal plane and is perpendicular to a line of horizontal travel in which the individual which carries the backpack travels, the y pivots being located forwardly of the back of the individual when the backpack is worn, said rear panel for the hipbelt comprising:

a substantially rigid cross piece;

a cushion;

means for attaching said cushion to said cross piece;

pivot connecting means for respectively connecting said cross piece to the two y pivots, wherein said cross piece and said cushion are located rearwardly of the two y pivots and said cushion is configured to engage the lower back of the individual, and wherein said pivot connecting means allow pivotal movement of said cross piece and said cushion with respect to the backpack when worn.

2. The rear panel of claim 1, wherein said cushion attachment means attaches to said cushion only at two distal areas, wherein said two distal areas are disposed one towards each of the two lateral ends of said cushion, wherein a central portion of said cushion between said two distal areas is generally flexible around axes which are roughly parallel to a vertical axis, wherein, in use, said central portion of said cushion is tensionally supported by said two distal areas.

3. The rear panel of claim 1 further including two secondary pivots, wherein said two secondary pivots are substantially coaxial, wherein said two secondary pivots pivot about axes substantially parallel to said y axis, wherein said two secondary pivots are incorporated into said pivot connecting means, wherein said two secondary pivots are disposed one on each side of said rear panel.

4. The rear panel of claim 1, wherein said cushion attachment means is at least partly composed of plastic.

5. The rear panel of claim 1, wherein said central portion of said cushion between said distal areas is at least partly composed of fabric.

6. The rear panel of claim 1 wherein a component of said crosspiece is a metal tube whose axis is substantially parallel to said y axis, wherein said pivot connecting means attach towards the lateral ends of said metal tube.

7. The rear panel of claim 1 wherein said cushion attachment means and said pivot connecting means are themselves interconnected.

8. A rear panel of a hipbelt for a backpack, the backpack having two spaced y pivots attached thereto configured to be located adjacent respective sides of an individual when the backpack is worn by the individual, wherein the axes of said two y pivots are substantially parallel to a y axis and are substantially coaxial, wherein the y axis is in a horizontal plane and is perpendicular to a line of horizontal travel in which the individual which carries the backpack travels, the y pivots being located forwardly of the back of the individual when the backpack is worn, said rear panel for the hipbelt comprising:

a cross piece which is substantially nonconformable;

a cushion;

means for attaching said cushion to said cross piece;

pivot connecting means for respectively connecting said cross piece to the two y pivots, wherein said cross piece and said cushion are located rearwardly of the two y pivots and said cushion is configured to engage the lower back of the individual, and wherein said two y pivots and said pivot connecting means allow pivotal movement of said cross piece and said cushion with respect to the backpack when worn.

9. The rear panel of claim 8, wherein said cushion attachment means attaches to said cushion only at two distal areas, wherein said two distal areas are disposed one towards each of the two lateral ends of said cushion, wherein a central portion of said cushion between said two distal areas is generally flexible around axes which are roughly parallel to a vertical axis, wherein, in use, said central portion of said cushion is tensionally supported by said two distal areas.

10. The rear panel of claim 8 further including two secondary pivots, wherein said two secondary pivots are substantially coaxial, wherein said two secondary pivots pivot about axes substantially parallel to said y axis, wherein said two secondary pivots are incorporated into said pivot correcting means, wherein said two secondary pivots are disposed one on each side of said rear panel.

11. The rear panel of claim 8, wherein said cushion attachment means is at least partly composed of plastic.

12. The rear panel of claim 8, wherein said central portion of said cushion between said distal areas is at least partly composed of fabric.

13. The rear panel of claim 8 wherein a component of said crosspiece is a metal tube whose axis is substantially parallel to said y axis, wherein said pivot connecting means attach towards the lateral ends of said metal tube.

* * * * *